United States Patent [19]

Bull et al.

[11] Patent Number: 4,535,675

[45] Date of Patent: Aug. 20, 1985

[54] APPARATUS FOR ROTATING A SET OF CARRIERS FOR A STRAND SUPPLY BOBBIN RELATIVE TO MOVING STRANDS FROM A SET OF CONTRA-ROTATING CARRIERS FOR A STRAND SUPPLY BOBBIN

[75] Inventors: Jeffrey F. Bull; Daniel W. Karg, both of Akron; Michael E. Winiasz, Lorain, all of Ohio

[73] Assignee: James F. Karg, Akron, Ohio

[21] Appl. No.: 673,385

[22] Filed: Nov. 20, 1984

[51] Int. Cl.[3] ..... D04C 3/06; D04C 3/24; D04C 3/42

[52] U.S. Cl. ..... 87/29; 87/37; 87/44; 87/48

[58] Field of Search ..... 87/14–17, 87/29, 30, 32–34, 37–40, 44–48, 54–57

[56] References Cited

U.S. PATENT DOCUMENTS

| | | | |
|---|---|---|---|
| 1,888,477 | 11/1932 | Standish | 87/47 |
| 1,955,206 | 4/1934 | Standish | 87/47 |
| 1,981,377 | 11/1934 | Standish | 87/47 |
| 2,464,899 | 3/1949 | Sokol | 87/48 |
| 2,672,071 | 3/1954 | Marogg | 87/46 |
| 3,892,161 | 7/1975 | Sokol | 87/29 |
| 4,034,642 | 7/1977 | Iannucci et al. | 87/48 |
| 4,034,643 | 7/1977 | Iannucci et al. | 87/48 |
| 4,275,638 | 6/1981 | De Young | 87/29 X |

*Primary Examiner*—John Petrakes
*Attorney, Agent, or Firm*—Mack D. Cook, II

[57] ABSTRACT

Apparatus for rotating a set of braiding machine front strand carriers around the front side of a first table carrying a set of contra-rotating rear strand carriers on the rear side. Strands from the rear carriers pass through arcuate slots in the first table. A second table is in front of the first table. The tables rotate in opposite directions. The apparatus of the invention has a shuttle for mounting each front carrier, with an arcuate slide tang having a length less than the distance between any two first table slots and carrying a radially inner drive block with two actuator slots. A circular shuttle mounting track carried on the first table front side has inner and outer roller segments between any two first table slots engaging the shuttle slide tangs. A circular actuator cam track carried on the first table has a set of inwardly directed V's with an apex inwardly of an inner end of each table slot. A set of shuttle drive assemblies is mounted on the rear side of the second table. Each drive assembly has two symmetrical and articulated drive arms extending laterally from a single actuator post. Each drive arm follows the cam track and carries an actuator dog for articulated movement into and out of driving engagement with a shuttle drive block actuator slot; so that rear carrier strands positioned at the inner end of each table slot pass between front strand carriers and drive assemblies.

3 Claims, 6 Drawing Figures

APPARATUS FOR ROTATING A SET OF CARRIERS FOR A STRAND SUPPLY BOBBIN RELATIVE TO MOVING STRANDS FROM A SET OF CONTRA-ROTATING CARRIERS FOR A STRAND SUPPLY BOBBIN

BACKGROUND OF THE INVENTION

The invention relates generally to an improved strand fabricating machine; also known in the art as a braiding machine.

More specifically, the invention relates to an apparatus for rotating a set of carriers for a strand supply bobbin relative to moving strands from a set of contra-rotating carriers for a strand supply bobbin.

A fair description of the purpose and use in a braiding machine of apparatus according to the invention is found in U.S. Pat. No. 1,888,477, 1932, Standish. Reference is made "to an improved method of driving the yarn supply carriers in a braiding machine . . . the rotary or circular orbit type of machine where the yarn from one set of supplies is passed either inside or outside of the yarn packages of a second set of supplies as are required to braid, and where both sets of supplies rotate in opposite directions about a common center." Standish discloses "improved means for passing yarn threads from one set of yarn supplies between a second set of yarn supply carriers moving in the opposite direction and the driving means for said second set." Standish uses "a rotary motion and discs having interrupted sectors and continuous sections substantially semi-circular in shape and adapted to secure interrupted contact with slots on said carriers and to maintain a continuous push or pull between the driving means and each of said carriers, and at the same time to allow ample clearance and time for passing the yarn between said driving means and carriers." (Col. 1, 11. 1-25).

An improvement by Standish on the rotary disc drive concept for moving one set of strand carriers relative to moving strands from a set of contra-rotating carriers is disclosed in U.S. Pat. No. 1,981,377, 1934. Standish II uses "substantially triangular shaped plates each having three projecting portions adapted to alternately make and break contact with a carrier". (Col. 1, 11. 21-24).

U.S. Pat. No. 3,892,161, 1975, Sokol, uses cam controlled pins or pivoting guide tubes 80 to direct wire or strand material from a set of outer bobbins 50 alternatively inwardly and outwardly relative to a moving set of inner bobbins 52.

U.S. Pat. No. 4,034,643, 1977, Iannucci, et al, drives the carriers 40 for an inner strand supply bobbin 20 by a mechanism 12 including pairs of dogs or pins 68 which alternately engage dual carrier slots 76, allowing passage by the moving outer strands 46 being guided by arms 48. A basic oscillating motion is imparted to the dogs 68 by pairs of bearing mounted shafts 62 each carrying a planetary gear 66 engaging a large circular gear 60. A crank 64 secured to each rotating shaft 62 is connected to a dog 68 through a linkage 80. The actual timing of rotation of each shaft 62 can be determined only by selecting the size and gearing of each of the circular gear 60 and planetary gear 66.

These and other prior art patents relating to rotary disc, cam controlled pin, and eccentric dog strand carrier drive mechanisms, for rotating one set of strand carriers relative to moving strands from another set of contra-rotating or stationary strand carriers, are to be found in Patent Office Class 87.

The prior art strand carrier drive mechanisms while effective, can fairly be characterized as involving components which have been costly to fabricate (eg. the gears 60 and 62 of Iannucci, et al), expensive to maintain (eg. the pivoting guide tubes 80 of Sokol), or have been both costly to fabricate and noisy to operate (eg. the rotary disc or lobed elements of Standish). Most of the prior art drive mechanisms have inherent sliding friction power losses.

So far as is known to the inventors, the art relating to braiding machine strand carrier rotatable mounting and drive mechanisms, whether inner-outer, upper-lower or front-rear, has not provided for articulated drive arms mounted on a single actuator post so that all carrier drive force is developed from a central point, has not had minimal sliding friction power loss factors, has not readily been capable of high speed operation at an acceptable noise level, and can not be fabricated and maintained at a relatively low cost.

SUMMARY OF THE INVENTION

It is an object of the invention to provide an improved strand fabricating machine.

It is a further object of the invention to provide an improved apparatus for rotating a set of carriers for a strand supply bobbin relative to moving strands from a set of contra-rotating carriers for a strand supply bobbin.

Still further, it is an object to provide a braiding machine strand carrier mounting and drive assembly which has symmetrical and articulated drive arms mounted on a single actuator post so that all carrier drive force is developed from a central point, which has minimal sliding friction power loss factors, which is capable of high speed operation at an acceptable noise level, and which may be fabricated and maintained at a relatively low cost.

These and other objects of the invention, as well as the advantages thereof, will become apparent in view of the drawings and the detailed description.

The invention is used with a braiding machine having a set of rear carriers for a strand supply bobbin mounted on the rear side of a first table for rotation in one direction. The strands from a set of supply bobbins on the rear carriers pass through a set of peripheral and radially arcuate slots in the first table. The braiding machine also has a second table in front of the first table. The braiding machine has a central axis stationary shaft for rotatable mounting of the first and second tables thereon. The braiding machine also has a drive mechanism for rotating the first and second tables in opposite directions.

An apparatus according to the invention, for mounting and driving a set of front carriers for a strand supply bobbin around the front side of the first table has a shuttle for each front carrier. A shuttle has a forwardly facing platform for mounting the base of a front carrier. A shuttle also has a rearwardly projecting segment of an arcuate slide tang having a length less than the spacing between any two of the first table arcuate slots. The radially inner side of a shuttle platform carries a shuttle drive block having two exteriorly opening actuator slots.

An apparatus according to the invention also has a circular shuttle mounting track carried on the front side of the first table and having arcuate segments extending between any two first table arcuate slots and engaging the shuttle slide tangs.

In the disclosed embodiment of the invention, a shuttle slide tang terminates in a keeper flange having a length less than the spacing between any two of the first table arcuate slots. The two shuttle drive block actuator slots are oriented radially outwardly toward the rotational axis of a bobbin on the front carriers. The shuttle mounting track segment is formed by an inner roller series and an outer roller series. The shuttle platforms are secured in a mounted position by positive engagement of the slide tang keeper flange between and with the inner and outer roller series.

An apparatus according to the invention also has a circular actuator cam track carried on the front side of the first table radially inwardly of the shuttle mounting track. The cam track follows a constant diameter broken by a set of radially inwardly directed V's. The apex of a cam track V is positioned radially inwardly of the inner end of one of the first table arcuate slots.

An apparatus according to the invention also has a shuttle drive assembly for each front carrier mounted on the periphery of the front table. A shuttle drive assembly has two symmetrical and articulated drive arms, mounted on and projecting laterally from a single actuator post. Each drive arm is in confined engagement with the actuator cam track on the first table. Each drive arm carries an actuator dog for articulated movement into and out of engagement with one of each two shuttle drive block actuator slots.

In the disclosed embodiment of the invention, a shuttle drive assembly has a clevis bracket mounted on the second table and extending toward the first table. The single actuator post extends through the clevis bracket. Each drive arm has a clevis base end for pivotal mounting around the actuator post and in engagement with the clevis bracket.

IN THE DRAWINGS

DETAILED DESCRIPTION OF THE INVENTION

Figure 1:
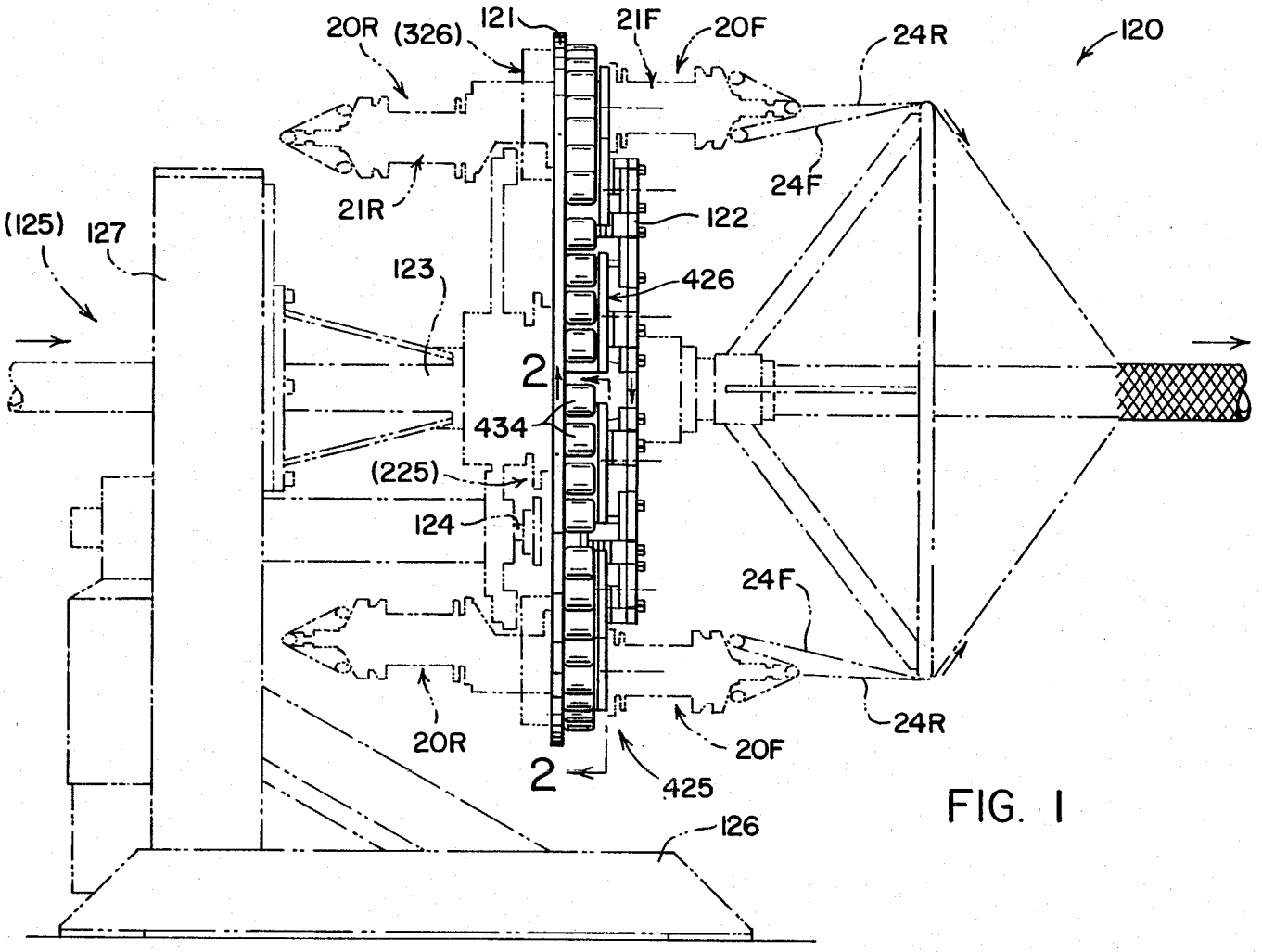
FIG. 1 is a side view of a braiding machine showing the front strand carrier mounting and drive assembly according to the invention in full lines, other components of the braiding machine being shown in chain lines.

A horizontal braiding machine, embodying the present invention, is referred to generally by the numeral 120. The braiding machine will have a set of rear carriers 20R for a strand supply bobbin mounted on the rear side of a first table 121 for rotation in one direction. The strands from bobbins on the rear carriers 20R pass through a set of peripheral and radially arcuate slots 327 in the first table 121. The braiding machine 120 will further have a set of front carriers 20F for a strand supply bobbin movable around the front side of the first table 121 for rotation by a second table 122 in the opposite direction. A stationary shaft 123 on the central axis of the braiding machine rotatably mounts the first table 121 and the second table 122 thereon. A drive mechanism power input shaft 124 extends substantially parallel to the stationary shaft 123 and toward the rear side of the first table 121.

The apparatus according to the invention, for mounting and driving a set of front carriers 20F for a strand supply bobbin relative to moving strands from a set of contra-rotating rear carriers 20R for a strand supply bobbin, is referred to generally by the numeral 425. The front strand carrier rotating apparatus components 425 are operable above a frame base 126 carrying a vertically oriented frame stanchion 127 for mounting the central axis stationary shaft 123 and the power input shaft 124.

Each set of carriers, 20R and 20F, and the strand supply bobbins, 21R and 21F, thereon, are shown only in chain lines. A moving length of strand material is indicated at 24R or 24F. A carrier 20 particularly suited for use on a braiding machine 120 may be as disclosed in U.S. patent appln. Ser. No. 648,064, filed Sept. 7, 1984, Bull, et al, Carrier For A Strand Supply Bobbin. Reference is made to said patent application for such further details as may be required to more fully understand the nature of the invention.

A mounting for the stationary shaft 123 and the power input shaft 124 is shown only by chain lines. A mounting assembly (125) particularly suited for use on a braiding machine 120 may be as disclosed in U.S. patent appln. Ser. No. 673,382, filed Nov. 20, 1984, Bull, et al, Apparatus For Mounting Of Components For Rotation Of Carriers For A Strand Supply Bobbin And For Timing Strand Movement Relative To Rotation. Reference is made to said patent application for such further details as may be required to more fully understand the nature of the invention.

A drive mechanism for selectively rotating the first table 121 and the second table 122 in opposite directions around the stationary shaft 123, in response to rotation of the power input shaft 124, is shown only by chain lines. A drive mechanism (225) particularly suited for use on a braiding machine 120 may be as disclosed in U.S. patent appln. Ser. No. 673,383, filed Nov. 20, 1984, Winiasz, Apparatus For Rotation Of Carriers For A Strand Supply Bobbin. Reference is made to said patent application for such further details as my be required to more fully understand the nature of the invention.

A strand control apparatus (325) including a set of mechanisms (326) for guiding moving strands 24R from the set of rear bobbins 21R, end to end within the first table arcuate slots 327, through an arc segment relative to the central axis of the braiding machine 120 is disclosed in U.S. patent appln. Ser. No. 673,384, filed Nov. 20, 1984. Bull, et al, Apparatus For Control Of Moving Strands From Rotating Strand Supply Bobbins. The disclosed strand guiding mechanism (326) has an elongated swing arm (342) carrying an eyelet 346 for engaging a moving strand 24R from a rear bobbin 21R prior to movement into a first table arcuate slot 327. Reference is made to said patent application for such further details as may be required to more fully understand the nature of the invention.

A carrier 20F for each front strand supply bobbin 21F is mounted for rotation around the central axis stationary shaft 123 on a shuttle indicated at 426. Each front carrier shuttle 426 has a forwardly facing platform 427 for mounting the base 28 of a front carrier 20F. Each shuttle platform 427 has a rearwardly projecting segment of an arcuate slide tang 428. Each slide tang 428 terminates in an enlarged diameter keeper flange 429. A slide tang 428 and keeper flange 429 have a length less than the spacing between any two or adjacent first table arcuate slots 327. The radially inner side of each shuttle platform 427 carries a shuttle drive block 430. Each drive block 430 has two exteriorly opening actuator slots 431. As shown, the actuator slots 431 are oriented radially outwardly toward the rotational axis of a front bobbin 21F.

A circular shuttle slide track indicated at 432 is carried on the front side of the first table 121. The slide track 432 has a set of arcuate segments, one for each carrier shuttle 426, with an effective radius less than the spacing between a pair of or adjacent first table arcuate slots 327. As shown, the slide track 432 is formed by an inner roller series 433 and an outer roller series 434 mounted on the front side of the first table 121. Each segment of the slide track 432 consists of a set of four inner rollers 433 cooperating with a set of four outer rollers 434. A shuttle platform 427 is secured in a mounted position by positive engagement of a slide tang keeper flange 429 between and with the the opposed slide rollers series 433 and 434.

A circular actuator cam track indicated at 435 is carried on the front side of the first table 121 radially inwardly of the sets of opposed inner and outer slide rollers 433 and 434 forming the segments of the shuttle slide track 432. The path of the cam track 435 follows a constant outer diameter broken by a set of inwardly directed V's 436, one for each carrier shuttle 426. The apex of each cam track V 436 is positioned radially inwardly of the inner end of an arcuate slot 327 in the first table 121.

Figure 5:
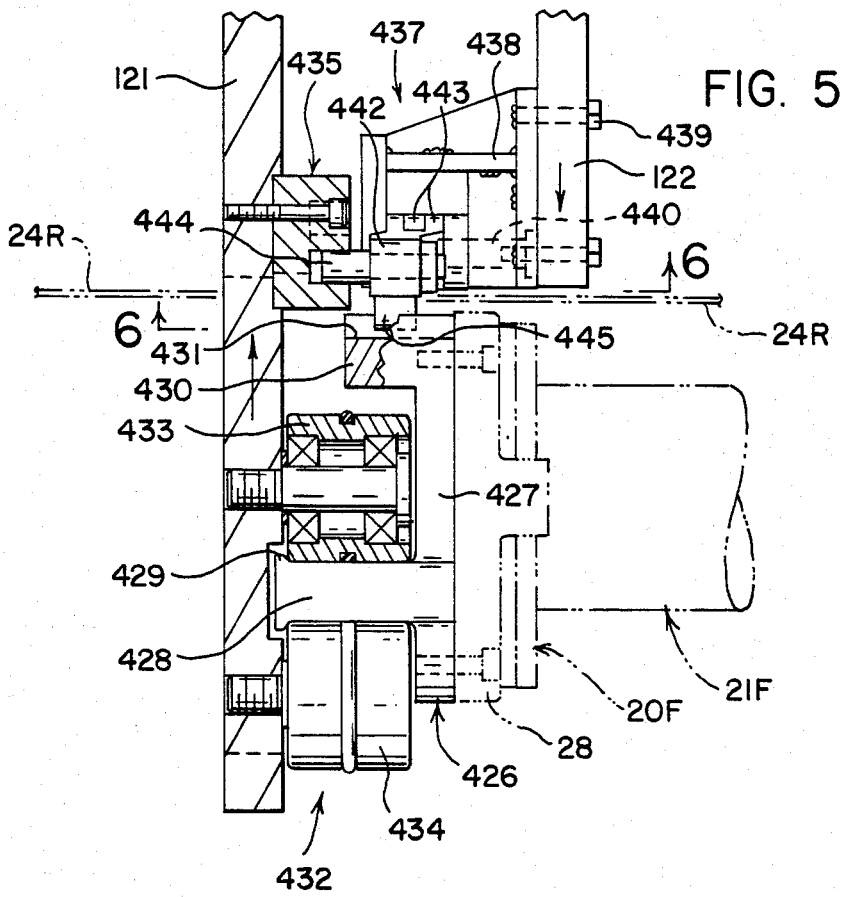
FIG. 5 is a side view, in section, taken substantially as indicated on line 5—5 of FIG. 2; and, FIG. 6 is a bottom plan, in section, taken substantially as indicated on line 6—6 of FIG. 5.
Figure 6:
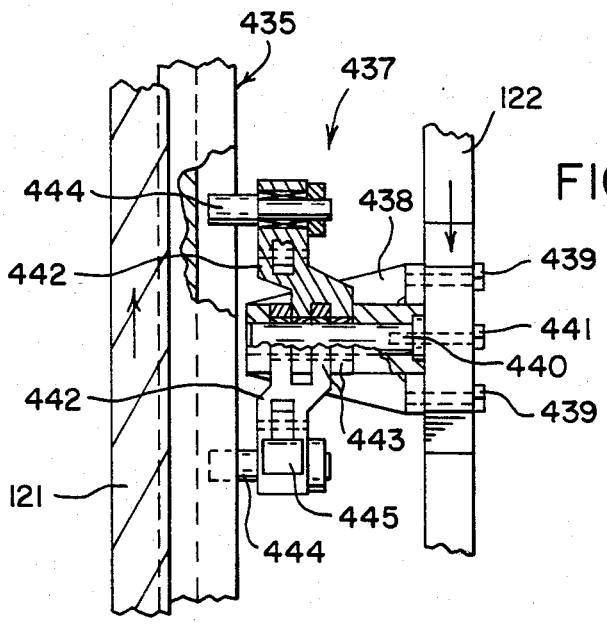

A set of shuttle drive assemblies indicated at 437, one for each carrier shuttle 426, is carried on the periphery of the rear side of the second table 122. Referring to FIGS. 5 and 6, a shuttle drive assembly 437 may have a clevis bracket 438 mounted on the second table 122, as by bolts 439, extending toward the first table 121. An actuator post 440 extends through the clevis bracket 438, toward the first table 121, and is attached to the second table 122, as by a bolt 441. The actuator post 440 provides for an articulated mounting of dual symmetrical and laterally projecting drive arms 442. As shown, each drive arm 442 has a clevis base end 443 for pivotal mounting around the actuator 440 and in engagement with the clevis bracket 438. The outer end of each drive arm 442 carries a cam follower 444 for confined engagement within the actuator cam track 435. The outer end of each drive arm 442 also carries an actuator dog 445 for articulated movement into and out of driving engagement with a similarly oriented shuttle drive block slot 431.

Figure 2:
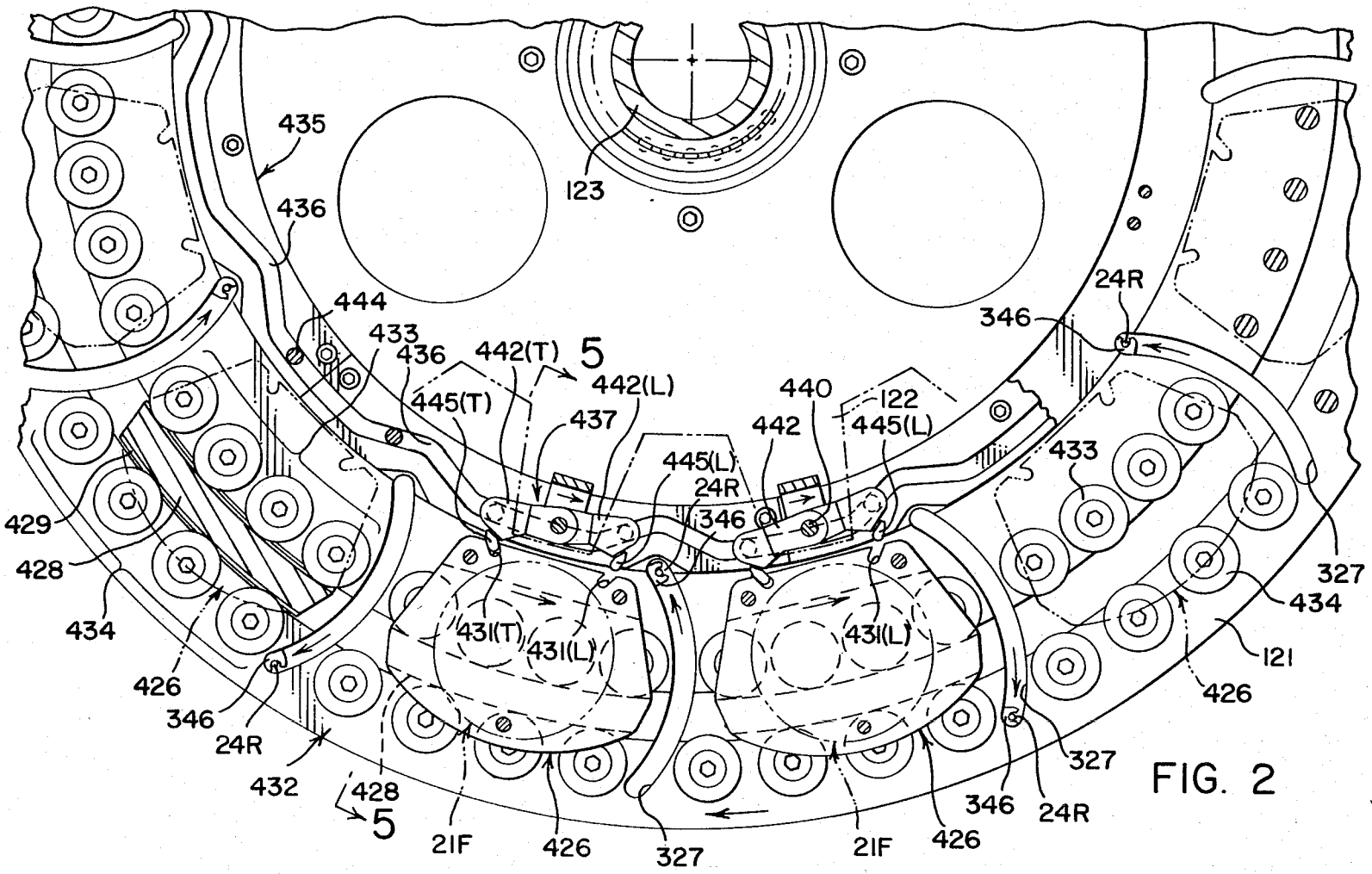
FIG. 2 is an enlarged fragmentary rear section, looking toward the rear of the braiding machine, taken substantially as indicated on line 2—2 of FIG. 1.
Figure 3:
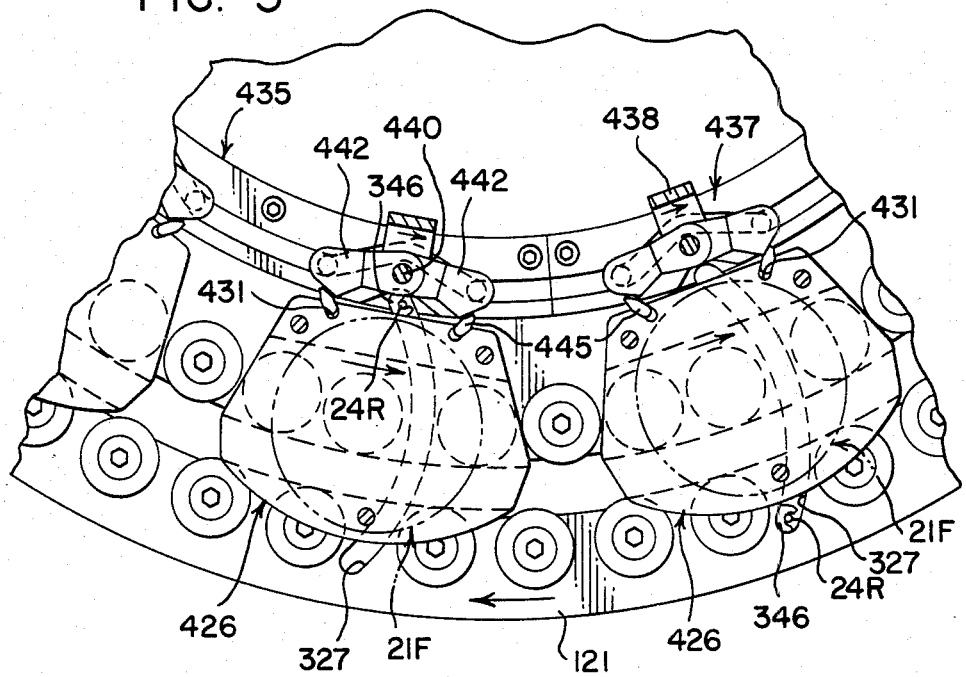
FIGS. 3 and 4 are related fragmentary rear sections, following sequentially after FIG. 2.
Figure 4:
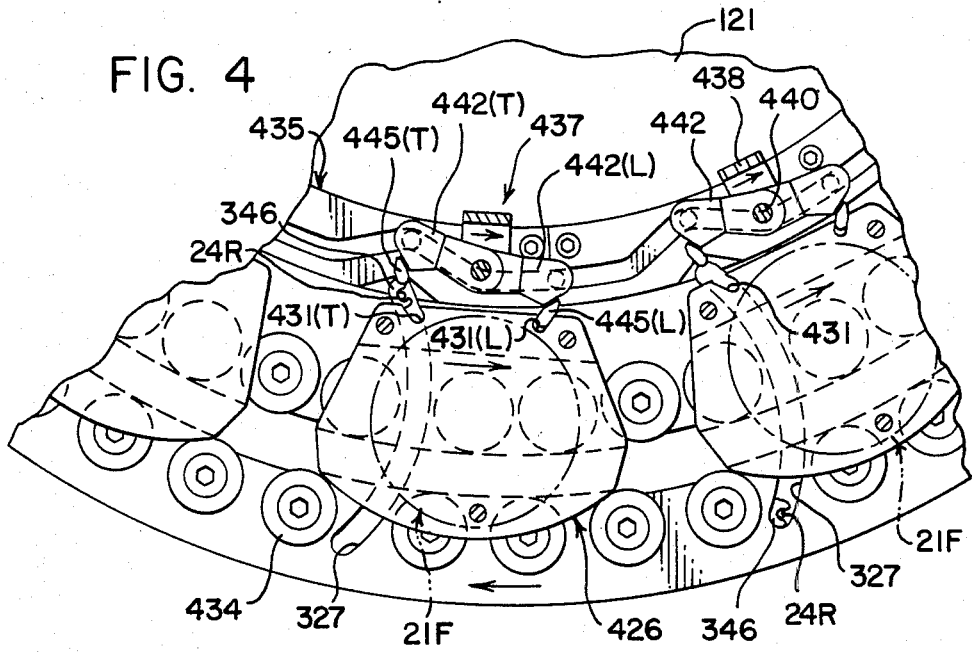

FIGS. 2, 3 and 4 are sequential views looking toward the rear of the braiding machine 120, during contra-rotation of the first table 121 and the second table 122.

In FIG. 2, the counter-clockwise rotating front carrier shuttles 426 are between the clockwise rotating first table arcuate slots 327. The rear strands 24R have been alternately moved to the inner and outer ends of the arcuate slots 327 by the strand guiding swing arm eyelet 346. The lead shuttle drive arms 442(L) are being moved by the actuator cam track V's 436 so that the lead actuator dogs 445(L) are moving out of engagement with the lead shuttle drive block slots 431(L) and the moving strands 24R at the inner ends of the arcuate slots 327 will pass between each shuttle platform 427 and each shuttle drive assembly 437. The trailing actuator dogs 445(T) carried by the trailing shuttle drive arm 442(T) are in driving engagement with the trailing shuttle drive block slots 431(T).

In FIG. 3, the moving strand 24R at the inner end of an arcuate slot 327 is between the drive arm actuator dogs 445 of a shuttle drive assembly 437 and passing by radially inwardly of a shuttle platform 427. The drive arm actuator dogs 445 carried by the drive arms 442 are in driving engagement with all of the shuttle drive block slots 431.

In FIG. 4, a trailing shuttle drive arm 442(T) has been moved by an actuator cam track V 436 so that a trailing actuator dog 445(T) is out of engagement with a trailing shuttle drive block slot 431(T) and the moving strand 24R at the inner end of an arcuate slot 327 may soon pass behind a shuttle platform 427; for movement by a strand guiding swing arm eyelet 346 to the outer end of an arcuate slot 327.

What is claimed is:

1. In a braiding machine having a set of rear carriers for a strand supply bobbin mounted on the rear side of a first table for rotation in one direction, the strands from a set of supply bobbins on said rear carriers passing through a set of peripheral and radially arcuate slots in said first table, a second table in front of said first table, a central axis stationary shaft for rotatable mounting of said first and second tables thereon, a drive mechanism for rotating said first and second tables in opposite directions, and an apparatus for mounting and driving a set of front carriers for a strand supply bobbin around the front side of said first table, said apparatus comprising:

a shuttle for each said front carrier, each said shuttle having a forwardly facing platform for mounting the base of a front carrier and a rearwardly projecting segment of an arcuate slide tang having a length less than the spacing between any two of said first table arcuate slots, the radially inner side of each shuttle platform carrying a shuttle drive block having two exteriorly opening actuator slots;

a circular shuttle mounting track carried on the front side of said first table and having arcuate segments extending between any two of said first table arcuate slots and engaging said shuttle slide tangs;

a circular actuator cam track carried on the front side of said first table radially inwardly of said shuttle mounting track, said cam track following a constant diameter broken by a set of inwardly directed V's, the apex of each said cam track V being positioned radially inwardly of the inner end of one of said first table arcuate slots; and, a shuttle drive assembly for each said front carrier mounted on the periphery of the rear side of said second table and having two symmetrical and articulated drive arms mounted on and projecting laterally from a single actuator post, each said drive arm being in confined engagement with said actuator cam track on said first table and carrying an actuator dog for articulated movement into and out of engagement with one of each said two shuttle drive block actuator slots.

2. An apparatus for mounting and rotating a set of front carriers for a strand supply bobbin around the front side of said first table according to claim 1 wherein each said shuttle slide tang terminates in a keeper flange having a length less than the spacing between any two of said first table peripheral slots, each said two shuttle drive block actuator slots are oriented radially outwardly toward the rotational axis of a bobbin on said front carriers, and, each said shuttle mounting track segment is formed by an inner roller series and an outer roller series; said shuttle platforms being secured in a mounted position by positive engagement of said slide tang keeper flanges between and with said inner and outer slide roller series.

3. An apparatus for mounting and rotating a set of front strand carriers for a strand supply bobbin around the front side of said first table according to claim 1 wherein each said shuttle drive assembly has a clevis bracket mounted on said second table and extending toward said first table and said single actuator post extends through said clevis bracket; and each said drive arm has a clevis base end for pivotal mounting around said actuator post and in engagement with said clevis bracket.

* * * * *